US005693211A

United States Patent [19]

Olsen

[11] Patent Number: 5,693,211

[45] Date of Patent: Dec. 2, 1997

[54] METHOD AND ARRANGEMENT FOR CLOSING AND COOLING THE TOP OF AN ANODE CASING FOR A SODERBERGANODE IN AN ELECTROLYTIC CELL

[75] Inventor: Arnt Tellef Olsen, Borhaug, Norway

[73] Assignee: Elkem Aluminium ANS, Norway

[21] Appl. No.: 532,722

[22] PCT Filed: Feb. 17, 1995

[86] PCT No.: PCT/NO95/00036

§ 371 Date: Oct. 5, 1995

§ 102(e) Date: Oct. 5, 1995

[87] PCT Pub. No.: WO95/22640

PCT Pub. Date: Aug. 24, 1995

[30] Foreign Application Priority Data

Feb. 21, 1994 [NO] Norway ..... 940578

[51] Int. Cl.[6] ..... C25C 3/22

[52] U.S. Cl. ..... 205/391; 204/247; 373/89

[58] Field of Search ..... 204/243 R–247, 204/241; 373/89, 93; 205/391, 392

[56] References Cited

U.S. PATENT DOCUMENTS 4,002,551 1/1977 Duclaux et al. ..... 204/247
4,436,607 3/1984 Fischer ..... 204/247 X
4,608,135 8/1986 Brown ..... 204/247 X
5,128,012 7/1992 Olsen .

FOREIGN PATENT DOCUMENTS 136678 11/1977 Norway .
269494 7/1970 U.S.S.R. ..... 204/247

*Primary Examiner*—Donald R. Valentine
*Attorney, Agent, or Firm*—Bierman, Muserlian and Lucas

[57] ABSTRACT

The present invention relates to a method for closing and cooling of the top of a Soderberganode for use in connection with electrolytic production of aluminum, which anode is equipped with an anode casing and vertical contact bolts for holding and for conducting operating current to the anode and where the top of the anode casing is equipped with at least one cover having openings for the contact bolts and at least one off-gas opening. The amount of gas removed from the top of the anode through the off-gas opening is regulated in such a way that a sufficient diminished pressure is provided on the top of the anode that surrounding air will flow through air gaps arranged between the cover and each of the contact bolts in such an amount that gas from the top of the anode does not escape through the air gaps and to keep the temperature of the top of the anode casing below a preset temperature. The present invention further relates to an arrangement for closing and cooling of the top of a Soderberganode used in connection with electrolytic production of aluminum where air gaps between 1 and 10 mm are arranged between each of the contact bolts and openings in the cover in order to allow flow of surrounding air in through the air gaps.

4 Claims, 3 Drawing Sheets

METHOD AND ARRANGEMENT FOR CLOSING AND COOLING THE TOP OF AN ANODE CASING FOR A SODERBERGANODE IN AN ELECTROLYTIC CELL

TECHNICAL FIELD

The present invention relates to a method and an arrangement for closing and cooling of the top of an anode casing for a Søderberganode in an electrolytic cell for production of aluminium.

The Søderberganode which is used in electrolytic production cells for aluminium comprises a permanent anode casing made from cast iron or steel, which casing surrounds the selfbaking carbon anode. Unbaked carbonaceous electrode paste is charged at intervals to the top of the anode and the unbaked electrode paste is baked to a solid carbon anode by means of the heat generated by the current supply to anode and by means of heat from the molten electrolytic bath. A main feature of the Søderberganode is thus that the baked anode is moved relatively to the permanent anode casing. Each electrolytic cell is normally equipped with one Søderberganode.

The Søderberganode is suspended by a large number of vertically arranged contact bolts normally made from steel, which also are used for conducting electric operating current to the anode. The lower ends of the contact bolts are baked into the anode. The contact bolts follow the downward movement of the anode until the lower ends reach a predetermined distance from the lower end of the anode. The contact bolts are then pulled out of the anode and placed in a higher position. By keeping the tip position of the contact bolts in different height positions in the anode, there will always be a sufficient number of bolts having such a tip position that a sufficient holding force is maintained and a good current connection between the bolts and the anode is secured.

The unbaked electrode paste which is charged to the top of the anode, evolves gases and volatile organic compounds during the baking process. Some of the gases and volatile compounds such as for example polyaromatic hydrocarbon compounds (PAH), are harmful to the health and it is therefore a wish to prevent these gases from escaping to the surroundings. Up till now it has been tried to reduce the outlet of gases from the top of the anode by using electrode pastes having a lowest possible content of volatile matter and by keeping the temperature on the top of the anode as low as possible. Even if the emission of gases from the top of the anode by these means has been reduced in the later years, it is not possible by the known technology to reduce emission of harmful gases from the anode top to an acceptable low level.

From Norwegian patent No. 172250 it is known to close the top of a Søderberganode by means of at least one cover having openings for the contact bolts and where annular gaps between the contact bolts and the openings in the cover are sealed by means of sealing elements and where the gases which evolve during the baking of the electrode paste are collected and combusted. According to the Norwegian patent the cover comprises central cover plates having openings for the contact bolts and side cover plates arranged outside the central cover plates, said side cover plates being rotatably arranged. The annular gaps between the central cover plates and the contact bolts are according to Norwegian patent No. 172250 sealed by means of sealing elements which are gas tight arranged about each of the contact bolts and which sealing elements are freely floating on the central cover plates. In order to make it more easy to replace damaged central cover plates, the central cover plates are made in sections where each section comprises openings for at least two and preferably four contact bolts.

The arrangement according to Norwegian patent No. 172250 has been found to have the disadvantage that the cooling of the top of the anode becomes too small, which gives a too high temperature on the top of the anode. This effects the softening and baking of the anode paste, as a too high part of the binder in the unbaked anode paste which is charged to the top of the anode, is volatilized and is sucked off together with the gases evolved during baking.

DISCLOSURE OF INVENTION

It is an object of the present invention to provide a method and an arrangement for closing and cooling of the top of the anode which makes it possible to keep the temperature of the top of the anode at a preset temperature during operation of the electrolytic cell.

Accordingly, the present invention relates to a method for closing and cooling of the top of a Søderberganode for use in connection with electrolytic production of aluminium, which anode is equipped with an anode casing and vertical contact bolts for holding and for conducting operating current to the anode and where the top of the anode casing is equipped with at least one cover having openings for the contact bolts and at least one off-gas opening, said method being characterized in that the amount of gas removed from the top of the anode through the off-gas opening is regulated in such a way that a sufficient diminished pressure is provided on the top of the anode that surrounding air will flow through air gaps arranged between the cover and each of the contact bolts in such an amount that gas from the top of the anode does not escape through the air gaps and to keep the temperature of the top of the anode below a preset temperature.

The present invention further relates to an arrangement for closing and cooling of the top of a Søderberganode used in connection with electrolytic production of aluminium which anode is equipped with an anode casing and vertical contact bolts for holding and for conducting operating current to the anode and where the top of the anode casing is closed by means of at least one cover having openings for the contact bolts and at least one opening for charging anode paste and at least one off-gas opening for continuously withdrawing gas from the top of the anode, said arrangement being characterized in that air gaps between 1 and 10 mm, preferably between 2 and 4 mm are arranged between each of the contact bolts and the openings in the cover, in order to allow a regulated flow of air into the air gaps for cooling of the top of the anode and to prevent leakages of gases from the top of the anode through the air gaps.

According to a preferred embodiment of the arrangement according to the present invention elements freely floating on the cover are arranged about each contact bolt and the air gaps are arranged between the elements and the contact bolts.

By regulating the amount of gas sucked out through the gas outlet opening in the cover, the amount of air flowing in through the air gaps between each contact bolt and the element will be sufficient to keep the temperature on the anode top below a preset value.

DETAILED DESCRIPTION OF PREFERRED EMBODIMENTS

Figure 1:
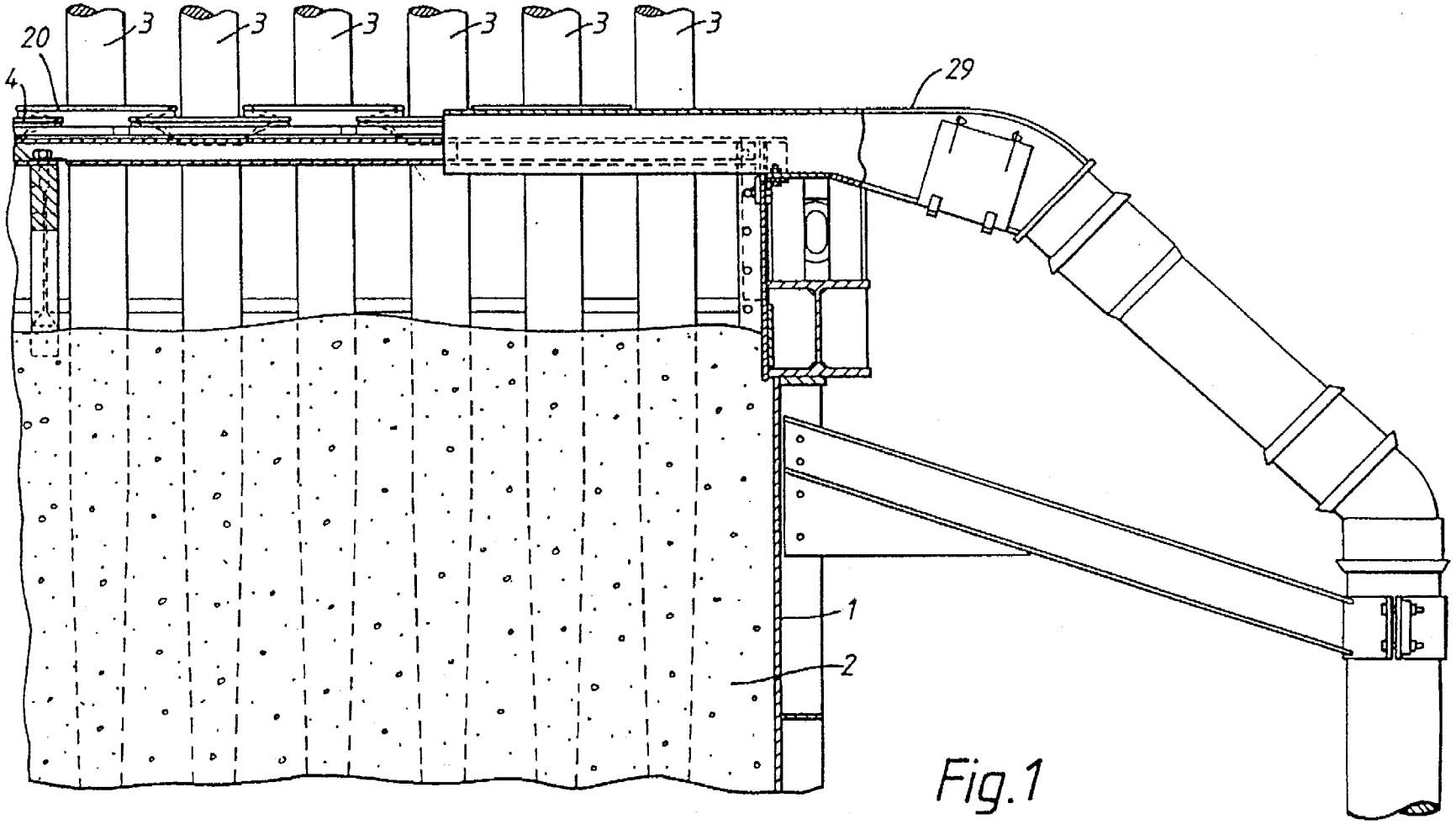
FIG. 1 shows a vertical cut through a part of a Søderberganode for an electrolytic cell for production of aluminium.
Figure 2:
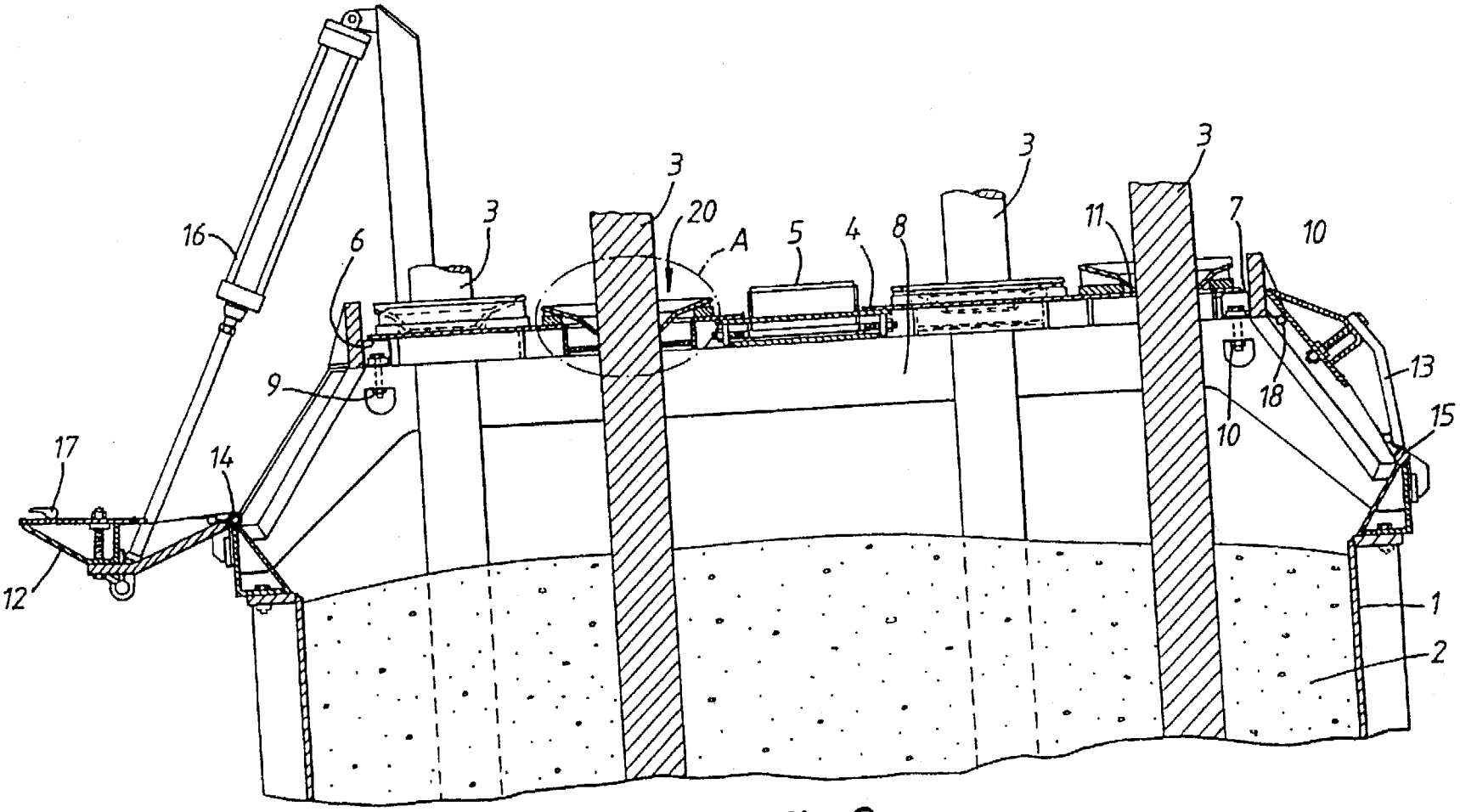
FIG. 2 shows a vertical cut through the top of a Søderberganode for an electrolytic cell for production of aluminium.

FIGS. 1 and 2 show a Søderberganode for electrolytic cells for production of aluminium. The anode comprises a casing 1 made from iron or steel. Into the anode casing 1 there is charged carbon containing anode paste 2. The carbon containing paste 2 is baked to a solid carbon anode by means of heat which evolves during current supply to the anode and heat from the electrolytic bath. The baked anode is consumed during the electrolytic process.

The carbon anode is held by a plurality of vertical contact bolts 3 which also serve as current conductors to the anode. As can be seen from the figures the contact bolts 3 are arranged in four rows in the longitudinal direction of the anode. The contact bolts 3 are suspended from current conducting beams in a conventional way (not shown on the figures).

The top of the anode is equipped with covers 4 connected to a central beam 5 arranged along the longitudinal axis of the anode, and two outer beams 6, 7 arranged on the outside of the rows of contact bolts. The beams 5–7 are suspended upon the short sides of the anode casing and preferably and at least one transversal beam 8. As shown in FIG. 2, the outer beams 6, 7 are connected to the transversal beam 8 by means of bolt connections 9, 10. The covers 4 have openings 11 for the contact bolts 3. Between the outer beams 6, 7 and the longitudinal sides of the anode casing there are arranged rotatably side covers 12, 13. According to the embodiment shown in FIG. 2 the side covers 12, 13 are suspended by pipes or rods 14, 15 rotatably connected to the top of the anode casing 1. The side covers 12, 13 can thereby be moved from a closed position showed for side cover 13 to an open position shown for side cover 12 by means of for example a pneumatic cylinder 16. When the side covers 12, 13 are in open positions anode paste 2 can be charged to the top of the anode and the top of the anode can be inspected visually. In order to ensure a good sealing between side covers 12, 13 and the outer beams 6, 7, there are preferably arranged flexible sealing sheets 17, 18 along the side covers 12, 13. These sealing sheets ensure a good sealing between the outer beams 6, 7 and the side covers 12, 13 when the side covers 12, 13 are in closed position.

Figure 3:
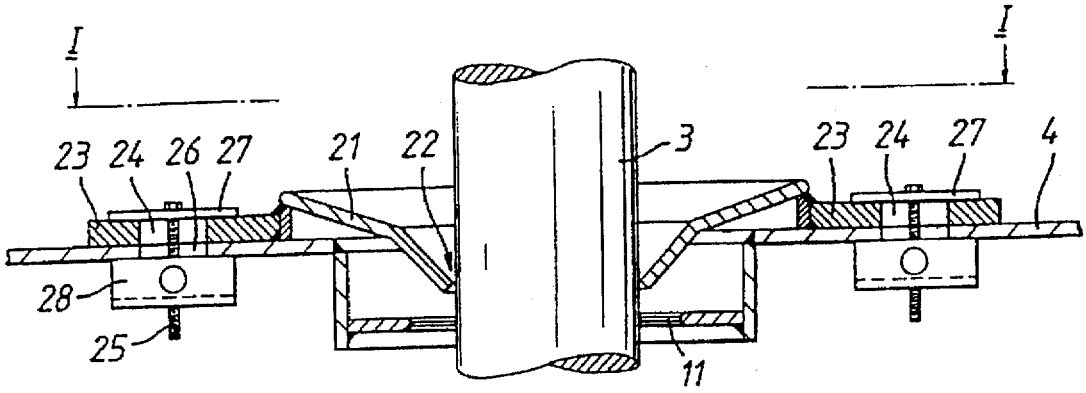
FIG. 3 shows an enlarged view of the area A in FIG. 2 in a first position.
Figure 4:
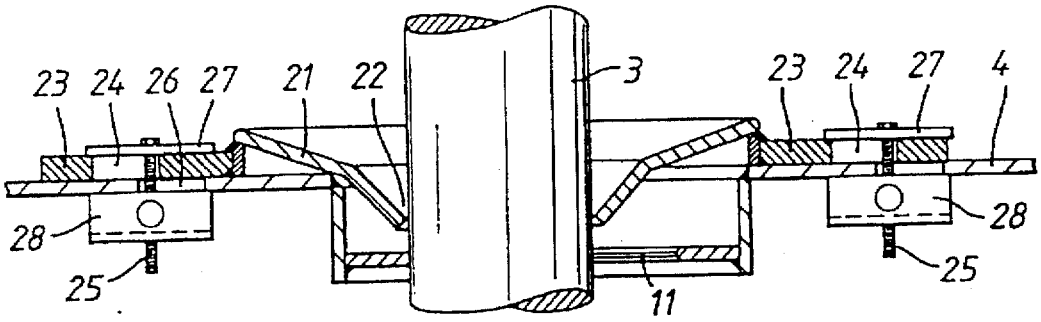
FIG. 4 shows an enlarged view of the area A in FIG. 2 in a second position, and where
Figure 5:
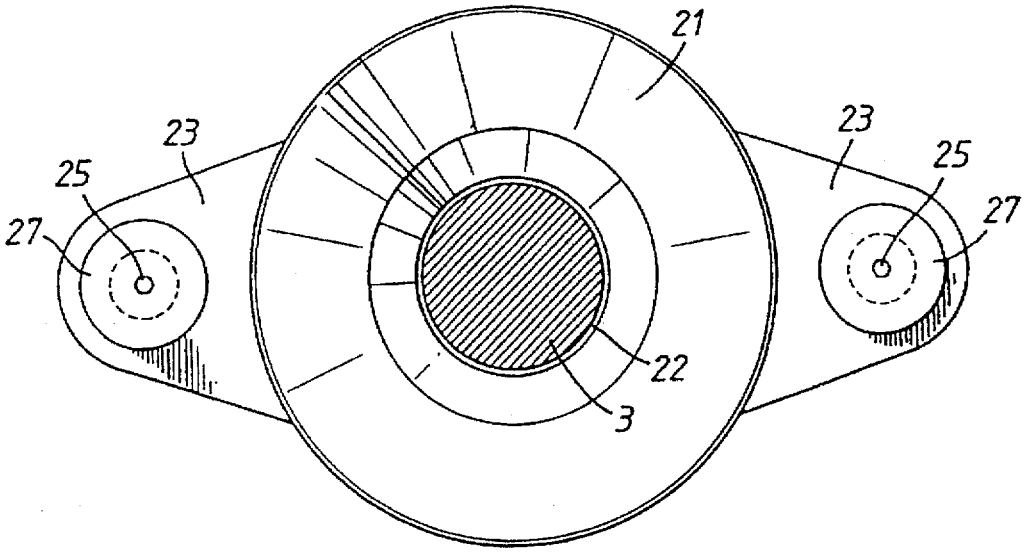
FIG. 5 shows a cut along line I—I in FIG. 3.

According to the present invention there are about each of the contact bolts 3 arranged elements 20 which are floating on the cover 4. The elements 20 are shown in detail in FIGS. 3–5. As shown in these figures each element comprises a ringshaped member 21 having a central opening with a diameter between 1 and 5 mm larger than the diameter of the contact bolts 3. A gap 22 is thus formed between the ringshaped member 21 and the corresponding contact bolts 3. The ringshaped member 21 is equipped with two horizontal brackets 23 each having an opening 24. The elements 20 are by means of a bolt 25 extending through the openings 24 in the brackets 23 and through a corresponding opening 26 in the cover 4 and flats 27, 28 placed respectively above the brackets 23 and below the cover 24, connected to the cover 4 in such a way that the elements 20 are allowed to move freely in the horizontal direction, but are prevented from being lifted vertically. On FIG. 3 the contact bolt 3 is shown centrally arranged in the opening 11 in the cover 4, while the contact bolt 3 on FIG. 4 is shown in a position where the contact bolt 3 due to horizontal forces has moved the element 20 horizontally on the cover 4.

During operation of the electrolytic cell gases evolved on the top of the anode are removed through a gas outlet opening 29 in the cover 4. The amount of gas removed through the gas outlet opening 29 is regulated in such a way that air flows through the air gaps 22 in such an amount that gases from the anode top are prevented from escaping through the air gaps 22.

The amount of gas which is removed through the gas outlet 29 is regulated in such a way that the amount of air flowing in through the air gaps 22 is sufficient to cool the top of the anode to a preset temperature.

By the means of the present invention there is provided a simple and reliable way to seal the top of the anode against the atmosphere at the same time as the temperature on the top of the anode can be kept at a preset value.

I claim:

1. Method for closing and cooling of the top of a Soderberganode for use in connection with electrolytic production of aluminium, which anode is equipped with an anode casing and vertical contact bolts for holding and for conducting operating current to the anode and where the top of the anode casing is equipped with at least one cover having openings for the contact bolts and at least one off-gas opening characterized in that the amount of gas removed from the top of the anode through the off-gas opening is regulated in such a way that a sufficient diminished pressure is provided on the top of the anode that surrounding air will flow through air gaps arranged between the cover and each of the contact bolts in such an amount that gas from the top of the anode does not escape through the air gaps and to cool the top of the anode.

2. Arrangement for closing and cooling of the top of a Søderberganode used in connection with electrolytic production of aluminium which anode is equipped with an anode casing (1) and vertical contact bolts (3) for holding and for conducting operating current to the anode and where the top of the anode casing (1) is closed by means of at least one cover (4) having openings (11) for the contact bolts (3) and at least one opening (12, 13) for charging anode paste and at least one off-gas opening (29) for continuously withdrawing gas from the top of the anode, characterized in that air gaps (22) between 1 and 10 mm, are arranged between each of the contact bolts (3) and the openings (11) in the cover (4), in order to allow a regulated flow of air into the air gaps (22) for cooling of the top of the anode and to prevent leakages of gases from the top of the anode through the air gaps (22).

3. Arrangement according to claim 2, characterized in that the air gaps (22) between the cover (4) and each of the contact bolts (3) are between 2 and 4 mm.

4. Arrangement according to claim 3, characterized in that elements (20) freely floating on the cover (4) are arranged about each contact bolt (3) and where the air gaps (22) are arranged between the elements (20) and the contact bolts (3).

* * * * *